United States Patent [19]

Lang et al.

[11] Patent Number: 4,955,206

[45] Date of Patent: Sep. 11, 1990

[54] LIQUID CRYOGEN FREEZER WITH IMPROVED VAPOR BALANCE CONTROL

[75] Inventors: Gary D. Lang, Naperville; Benjamin Zyer, Orland Park, both of Ill.

[73] Assignee: Liquid Carbonic Corporation, Chicago, Ill.

[21] Appl. No.: 443,903

[22] Filed: Nov. 30, 1989

[51] Int. Cl.[5] ..... F17D 17/00

[52] U.S. Cl. ..... 62/186; 62/266; 62/374; 62/380

[58] Field of Search ..... 62/186, 266, 374, 380, 62/381

[56] References Cited

U.S. PATENT DOCUMENTS

| | | | |
|---|---|---|---|
| 3,255,608 | 6/1966 | MacIntosh | 62/374 |
| 3,404,989 | 10/1968 | Hirtensteiner | 99/193 |
| 3,485,055 | 12/1969 | Webster et al. | 62/63 |
| 3,553,973 | 1/1971 | Moran | 62/63 |
| 3,728,869 | 4/1973 | Schmidt | 62/266 |
| 3,824,806 | 7/1974 | Wagner | 62/380 |
| 3,916,640 | 11/1975 | Rasovich | 62/266 |
| 4,086,783 | 5/1978 | Wagner et al. | 62/374 |
| 4,086,784 | 5/1978 | Wagner | 62/374 |
| 4,090,369 | 5/1978 | LeDiouron | 62/380 |
| 4,237,695 | 12/1980 | Oberpriller et al. | 62/63 |
| 4,276,753 | 7/1981 | Sandberg et al. | 62/186 |
| 4,350,027 | 9/1982 | Tyree, Jr. | 62/374 |
| 4,386,504 | 6/1983 | Brautigam | 62/380 |
| 4,403,479 | 9/1983 | Rasovich | 62/63 |
| 4,475,351 | 10/1984 | Klee | 62/63 |
| 4,528,819 | 7/1985 | Klee | 62/63 |
| 4,589,264 | 5/1986 | Astrom | 62/374 |
| 4,627,244 | 12/1986 | Willhoft | 62/380 |
| 4,739,623 | 4/1988 | Tyree, Jr. et al. | 62/63 |
| 4,745,762 | 5/1988 | Taylor | 62/374 |
| 4,783,972 | 11/1988 | Tyree, Jr. et al. | 62/374 |
| 4,800,728 | 1/1989 | Klee | 62/380 |
| 4,866,946 | 9/1989 | Klee | 62/266 |

*Primary Examiner*—Ronald C. Capossela

*Attorney, Agent, or Firm*—Fitch, Even, Tabin & Flannery

[57] ABSTRACT

A cryogenic freezer apparatus for food products, including a thermally insulated enclosure and conveyor means for conveying products through the enclosure. A cryogen unit in the enclosure produces cryogen vapor near the enclosure entrance, and a blower unit is located in the enclosure adjacent the entrance thereof. The blower unit is selectively reconfigurable in response to a blower control signal to selectively direct cryogen vapor in varying directions, drawing cryogen vapor away from a first portion of the enclosure and blowing cryogen vapor toward a second portion of the enclosure. A photocell unit outside the enclosure, adjacent the entrance thereof, detects cryogen vapor exiting the enclosure entrance and generates at least one sensor output signal in response thereto, being indicative of the amount of cryogen vapor exiting. A control unit is coupled to the photocell unit and to the blower unit for generating a blower control signal in response to the sensor output signal so that, with increasing vapor detected outside the entrance of the enclosure, the blower unit draws cryogen vapor away from the enclosure entrance. Also, upon detecting a decreasing amount of cryogen vapor exiting from the entrance of the enclosure, the blower unit directs less cryogen vapor away from the enclosure entrance to assure that intrusion of the ambient environment through the enclosure entrance is prevented.

21 Claims, 7 Drawing Sheets

LIQUID CRYOGEN FREEZER WITH IMPROVED VAPOR BALANCE CONTROL

BACKGROUND OF THE INVENTION:

The invention pertains to cryogenic freezing apparatus, and more particularly to such apparatus using a liquid cryogen, such as nitrogen, for cooling articles within a freezer apparatus. The present invention is particularly directed to a freezer apparatus which operates on a continuous stream of articles as opposed to such apparatus operating in a batch mode.

Various types of cryogenic cooling apparatus are known, and in general do a satisfactory job of cooling or freezing various articles. Two popular types of cryogenic apparatus in use today are commonly known as "spiral freezers" and "tunnel freezers". Both of these types of apparatus operate in a continuous mode, where articles such as foodstuffs or the like are continuously fed through the freezer apparatus with the stream of articles leaving the cooling apparatus being cooled or frozen, as desired. A cryogen immersion bath may be provided at the entrance end of the tunnel or spiral freezer, and if so, the freezer is commonly termed a "cryogen immersion freezer."

One particularly popular type of such freezer apparatus in use today employs a liquid cryogen, such as nitrogen, in which the articles are either fully or partly immersed, or alternatively the liquid cryogen is allowed to vaporize, thereby cooling the interior of the freezing chamber. Early designs of such freezer apparatus, known as "isothermal" freezers, operate at one low temperature throughout the cooling or freezing chamber. Commonly assigned U.S. Pat. No. 4,739,623 offered significant improvements to such freezers, greatly increasing the efficiency thereof by controlling the escape of cryogen vapors created in the freezer which, after being made to circulate through the interior of the freezing chamber, are allowed to escape through the warmest portions thereof. In the U.S. Pat. No. 4,739,623, a spiral conveyor is provided and a fan at the freezer entrance directs air toward the "stack" of coils of the spiral conveyor. Also employed in the freezing chamber are several circulating blowers to maintain desired cooling in various portions of the freezing chamber. One such blower is mounted adjacent the inlet to the freezing chamber and is controlled in response to temperature sensed at an exhaust duct. Ambient air surrounding the freezing chamber is channeled through the exhaust duct, and if the temperature thereof should rise in an undesirable manner, the blower adjacent the freezer inlet is decreased in speed to permit cold cryogen to escape through the entrance to the freezing chamber thereby blocking infiltration of the ambient air into the freezing chamber. Conversely, if the temperature in the exhaust duct should decrease more than a desirable amount, fan speed adjacent the freezer inlet is increased to blow more cold cryogen vapor toward the path through which the articles travel during freezing.

Commonly assigned U.S. Pat. Nos. 4,350,027 and 4,783,972 disclose tunnel-type cooling apparatus. Both apparatus use liquid cryogen cooling media and both have a series of blowers internal to the tunnel for facilitating cooling. U.S. Pat. No. 4,783,972 discloses a baffle and damper arrangement which is adjusted by a control motor in accordance with the temperature of vapor leaving an upwardly directed chimney or venting duct. If an elevated temperature is sensed, for example, the baffle and damper arrangement is adjusted to direct additional cryogen vapor toward the entrance end of the tunnel. The temperature sensed at the outlet of the duct is that of a mixture of cryogen vapor and ambient air which has infiltrated the entrance area. Thus, the temperature reading at the exit end of the duct is an indirect measurement of the condition at the entrance. While this arrangement has met with considerable commercial success, a more direct, i.e., more tightly coupled, control is desirable to further increase the efficiency of operation.

U.S. Pat. No. 4,276,753 provides another example of liquid cryogen freezing in a tunnel freezer. A conveyor belt is oriented in a generally straight line and passes through a tunnel enclosure within which liquid cryogen is dispersed by injection lines and circulated with a sequence of blower fans. A directional blower is located in the tunnel remote from the entrance end and circulates cryogen vapor in a counter direction, opposite that of the travel of the conveyor and the articles carried thereon. An exhaust blower is located at the top of a chimney or exhaust stack located above the entrance to the tunnel. A temperature sensor is mounted adjacent the downstream end of the tunnel and drives a control for the exhaust blower and the directional blower. When temperature adjacent the exit end of the tunnel increases above a preset level, the input of liquefied cryogen in the tunnel is increased and the operating speeds of the directional blower and exhaust blower are increased. Conversely, when the temperature sensed in the tunnel adjacent the exit end thereof falls below a lower preset, less liquefied cryogen is introduced into the tunnel and the operating speeds of the directional blower and exhaust blower are decreased. Thus, the exhaust blower located adjacent the entrance end of the tunnel is controlled by temperature sensed adjacent the exit end of the tunnel, fan speed being increased to prevent unacceptably high amounts of infiltration of ambient air into the freezing tunnel.

U.S. Pat. No. 4,403,479 discloses another example of a liquid cryogen freezing apparatus, comprising an upstream immersion bath for articles to be frozen, and a downstream freezing tunnel to complete the freezing or cooling process. An exhaust chimney or duct is provided at the outlet of the tunnel to draw cryogenic vapor from the immersion bath through the tunnel for further cooling of the articles, subsequent to the initial immersion. An amount of the liquid cryogen used in the immersion bath is allowed to spill, to create a cryogen vapor pressure, preventing infiltration of ambient air into the entrance of the cooling apparatus. The tunnel is operated without re-circulating fans and without vapor spray inlets. An exhaust fan adjacent the exit end of the tunnel and baffles within the tunnel are, however, employed.

Despite the advances discussed above, further improvements to liquid cryogen cooling apparatus are still being sought. For example, a significant improvement in efficiency of operation of a cooling apparatus can be obtained if vapor balance at the entrance to the freezing apparatus, where articles to be frozen are introduced, can be more closely controlled.

Other advances are being sought to provide a retrofit enhancement to existing mechanical cooling systems which are no longer adequate to handle increased product throughput. A liquid cryogen cooling tunnel could be employed at the entrance to the mechanical cooling system, but economies of operation dictate that the efficiency of the added cryogen system be sufficiently efficient to justify the added capital investment. Accordingly, liquid cryogen tunnel freezers of compact size and capable of economical efficient operation are being sought for such applications.

SUMMARY OF THE INVENTION

It is an object according to the present invention to provide an improved vapor balance at the entrance end of liquid cryogenic freezing or cooling apparatus.

A further object according to the present invention is to provide a vapor balance control for such apparatus by measuring one or more operating parameters adjacent the entrance to the apparatus, rather than at some point remote therefrom.

A further object according to the present invention is to provide vapor balance controls which can be used on virtually any type of liquid cryogen freezing apparatus, including spiral freezers and tunnel freezers in popular use today, and for such freezers using cryogenic immersion or cryogenic spray to augment the freezing or cooling process.

These and other objects according to the present invention, which will become apparent from studying the appended description and drawings, are provided in a cryogenic freezer apparatus for food products, comprising:

a thermally insulated enclosure having an entrance and an exit;

conveyor means for conveying products through said enclosure, from said entrance to said exit;

cryogen means in said enclosure for producing cryogen vapor near said enclosure entrance;

blower means in said enclosure adjacent the entrance thereof, selectively reconfigurable in response to a blower control signal to selectively direct cryogen vapor in varying directions, drawing cryogen vapor away from a first portion of said enclosure and blowing cryogen vapor toward a second portion of said enclosure;

photocell means outside said enclosure, adjacent the entrance thereof, for detecting cryogen vapor escaping out of the enclosure entrance and for generating at least one sensor output signal in response thereto, said at least one sensor output signal being indicative of the amount of cryogen vapor escaping out of said entrance; and control means coupled to said photocell means and to said blower means for generating a blower control signal in response to said at least one sensor output signal, so that, with increasing vapor detected outside the entrance of said enclosure, the blower means draws cryogen vapor away from said enclosure entrance, so as to reduce the amount of cryogen vapor escaping through said enclosure entrance, and so that, upon detecting a decreasing amount of cryogen vapor escaping from the entrance of said enclosure, the blower means blows cryogen vapor toward the enclosure entrance to assure that intrusion of the ambient environment through the enclosure entrance is prevented.

Other objects of the present invention are attained in apparatus of the above-described type wherein said photocell means comprises a single photocell with proportional sensing disposed adjacent said enclosure entrance, with means for generating a varying sensor output signal in proportion to the amount of vapor detected.

Still further objects of the present invention are attained in apparatus of the above-described type wherein said photocell means comprises first, lower, and second, upper photocell means, spaced one above the other outside said enclosure adjacent the entrance thereof, for detecting cryogen vapor escaping out of said entrance and for generating first and second electrical signals, when cryogen vapor is detected at lower and upper portions of said entrance, respectively.

In one embodiment, the blower means includes baffle means which are selectively reconfigurable in response to a blower control signal to selectively direct cryogen vapor in varying directions, drawing cryogen vapor away from a first portion of said enclosure and blowing cryogen vapor toward a second portion of said enclosure, so that, with increasing vapor detected outside the entrance of said enclosure, the baffle means is directed to draw cryogen vapor away from said enclosure entrance, so as to reduce the amount of cryogen vapor escaping through said enclosure entrance, and so that, upon detecting a decreasing amount of cryogen vapor escaping from the entrance of said enclosure, the baffle means is directed to blow cryogen vapor toward the enclosure entrance to assure that intrusion of the ambient environment through the enclosure entrance is prevented.

In another embodiment, the enclosure comprises a tunnel, and said blower means is located above said conveyor means and draws cryogen vapor from below, directing blower discharge in at least one of said directions toward the enclosure entrance and toward downstream portions of said conveyor means. The tunnel enclosure can be used with both cryogenic spray and cryogenic immersion treatment of the product near the entrance end thereof.

BRIEF DESCRIPTION OF THE DRAWINGS

In the drawings, wherein like elements are referenced alike.

DETAILED DESCRIPTION OF THE PREFERRED EMBODIMENT

Figure 1:
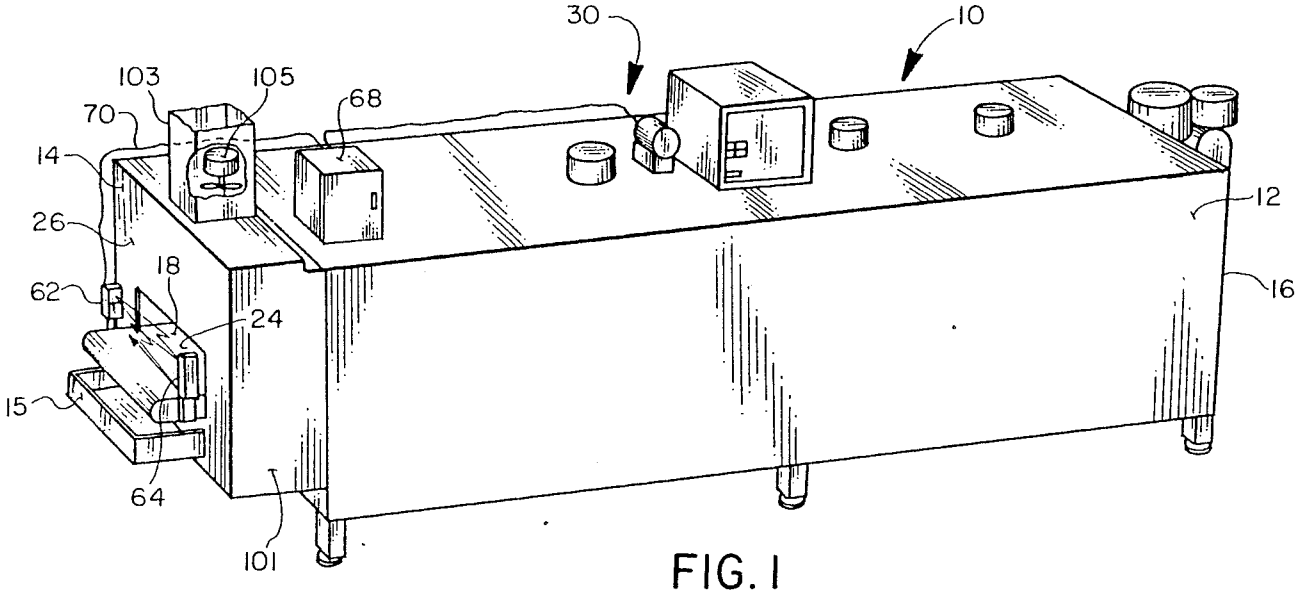
FIG. 1 is a perspective view of a first embodiment of a freezing apparatus illustrating principles according to the present invention.

Referring now to the drawings, and initially to FIG. 1, a liquid cryogen freezer apparatus according to principles of the present invention is illustrated in FIG. 1, the freezer apparatus being generally indicated at 10. Apparatus 10 includes an enclosure 12 that is formed with thermally insulated side, top and bottom walls and has an entrance end 14 and an exit end 16. An endless conveyor 18 carries products to be cooled or frozen through the freezer. The present invention is particularly useful for cooling or freezing food products or other organic materials. However, it will become apparent from studying the following that principles of the present invention can be adapted to the cooling or freezing of other types of products.

The present invention, as will be seen herein, provides a control of the vapor balance at the enclosure entrance by employing a variety of sensor systems outside the enclosure, adjacent entrance 24, to more directly detect the amount of vapor discharged through entrance 24. As will be seen in one preferred embodiment of the present invention, a single sensor is provided adjacent the enclosure entrance 24 to provide a proportional control of the vapor balance at the enclosure entrance. In another preferred embodiment, a pair of sensors are used to provide an incremental control of the vapor balance.

Figure 2:
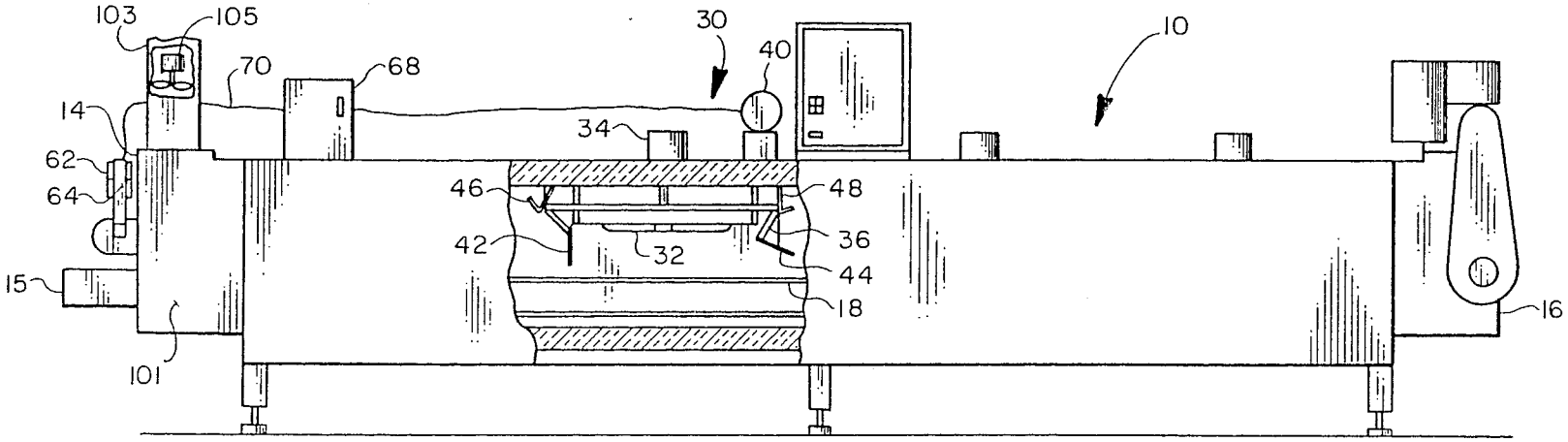
FIG. 2 is a side-elevational view, shown partly broken away, of the apparatus of FIG. 1.

Turning to FIGS. 1 and 2, conveyor 18 passes through an entrance opening 24 formed in the enclosure wall 26, located at the entrance end 14 of the enclosure. Freezer 10 includes a blower system generally indicated at 30, which is disposed adjacent entrance 24. The blower system 30 includes a fan 32 driven by an electric motor 34. The blower system 30 further includes a baffle arrangement 36.

The blower system (including the baffle arrangement 36) and auxiliary blowers located downstream thereof (not shown in the drawings) are substantially as described in commonly assigned U.S. Pat. No. 4,783,972, which is herein incorporated by reference as if fully set forth herein. The freezer described in U.S. Pat. No. 4,783,972 includes a tunnel-like enclosure and a liquid cryogen immersion bath adjacent the entrance end thereof. As is fully described in U.S. Pat. No. 4,783,972, the baffle arrangement includes a control motor herein identified by the reference numeral 40. A series of linkages and crank arms interconnect the motor 40 with upstream and downstream dampers 42, 44, respectively.

The blower motor can be operated in reverse directions, to change the direction of rotation of the fan blades, thus reversing the direction of air circulation through the baffle arrangement. As specifically contemplated herein, the blower system is also readily adaptable, without modification, for use with so-called "tunnel freezing" applications where the fan discharge is downwardly directed, as well as "cryogen immersion" applications where the blower system is located downstream of a cryogen immersion bath with fan discharge being upwardly directed. As specifically contemplated herein, only a reversal of direction of rotation of motor 34 is needed to accommodate one or the other application.

In the orientation depicted in FIG. 2, the upstream damper 42 is lowered to block or retard air flow at that end of the baffle arrangement. The downstream damper 44 is open to allow air flow circulation at the downstream end of the baffle arrangement. Thus, for cryogen immersion freezer applications where fan circulation is upwardly directed, cryogen vapor is drawn from an area surrounding blower system 30, upwardly past the fan blade. With the dampers 42, 44 shown in the orientation illustrated in FIG. 2, cryogen vapor is drawn from areas downstream of the blower system.

A second set of damper plates 46, 48 are located above the damper plates 42, 44, respectively. As illustrated in FIG. 2, the upper or superior upstream damper plate 46 is open, thus directing fan discharge toward entrance end 14 and the entrance opening 24 of enclosure 12. As Will be seen herein, with freezer apparatus 10 adapted for cryogen immersion applications, the orientation of blower system 30 as illustrated in FIG. 2 provides an increased partial pressure of cryogen vapor at entrance 24, an action which typically would be helpful in insuring that ambient air outside enclosure 12 surrounding entrance 24 does not intrude into the enclosure interior.

If the freezer apparatus 10 is adapted for so-called "tunnel freezer" applications, where liquid cryogen is sprayed onto the product being treated, the fan 32 must be rotated in an opposite direction so as to discharge downwardly. In the orientation shown in FIG. 2, a suction is applied adjacent the entrance end of the freezer enclosure, being drawn past the upstream baffle plate 46, and downwardly discharged toward portions of conveyor belt 18 underlying the blower system. Such an orientation of the blower system would be helpful, for example, if excessive amounts of cryogen vapor are being discharged through enclosure entrance 24. As contemplated herein, "excessive" amounts are those discharge rates of cryogen vapor which exceed the minimal discharge rate necessary to attain an "air lock" at the enclosure entrance, successfully preventing the intrusion of ambient environment into the enclosure interior.

Figure 3:
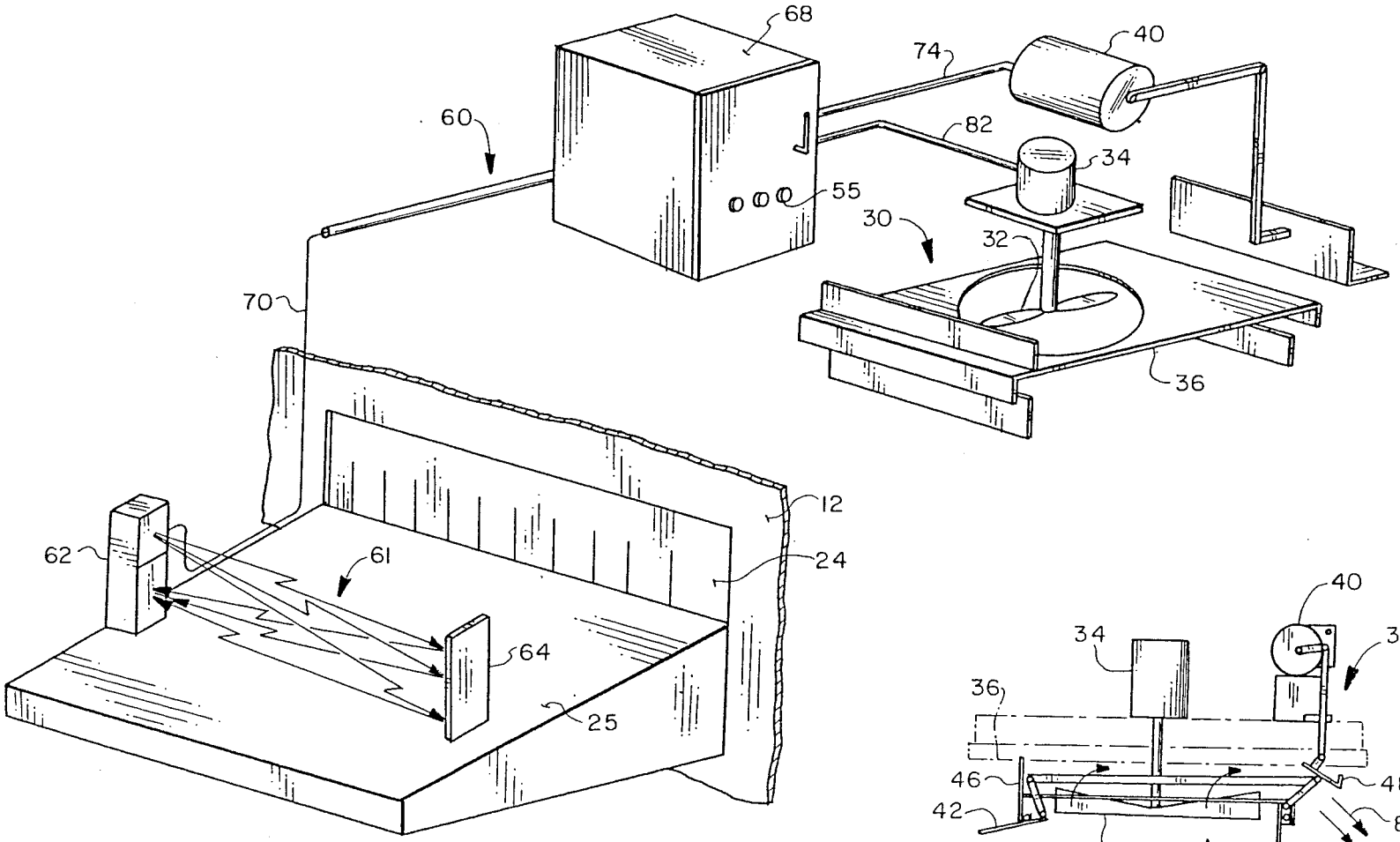
FIG. 3 is a schematic illustration of the vapor balance control and main blower systems used in the apparatus of the preceding figures.

Attention is now directed to the automatic vapor balance control provided by the present invention. An automatic vapor balance control system is schematically illustrated in FIG. 3, and is generally indicated by the reference numeral 60. A transmitter/receiver set 61 is located adjacent the enclosure entrance opening 24, lying outside of the enclosure 12. Although descriptions will be given herein for vapor balance control for entrance openings, those skilled in the art will readily appreciate that the present invention can also be employed to control the vapor outflow out of other enclosure openings, such as an exit opening. The transmitter/receiver set 61 includes first and second elements 62, 64, respectively. In the Preferred Embodiment, element 62 comprises a photocell transmitter/receiver unit and element 64 comprises a reflector. In FIG. 3, the conveyor 18 has been removed to show an underlying support surface 25.

The elements 62, 64 are laterally disposed one from the other lying on either side of conveyor belt 18 so as to monitor a signal path above the conveyor immediately outside the enclosure entrance 24. In the Preferred Embodiment, infrared radiation is emitted from element 62, passing over conveyor belt 18 and striking the second element 64. The radiation is then reflected back to the first elements 62 which emit an output signal indicative of the strength of the reflected radiation. If moisture present in cryogen vapor is present at the enclosure entrance 24, the condensed moisture will interrupt the light path extending between element 62, 64 and thus cause an attenuation which is sensed in the first element 62. A denser vapor discharge from the enclosure entrance will attenuate the reference signal still further, with the first element 62 being able to detect the increased attenuation. The output signal is transmitted to a control unit 68 via a signal line 70.

According to other aspects of the present invention, the elements 62, 64 of the transmitter/receiver set may optionally comprise a transmitter unit for the second element 64 and a receiver unit for the first element 62. A system of this type would measure a "single pass" attenuation of the reference signal passing between the elements 62, 64. The output signal of the receiver can be calibrated under standardized conditions, using a reference signal emitted from element 64. It will be appreciated by those skilled in the art that the transmitter/-receiver sets need not operate at infrared frequencies but could, for example, operate at audible, optical and ultraviolet frequencies as well.

As mentioned, the output from the receiving elements is transmitted along conductor 70 to a control unit 68, providing an interface to the baffle motor 40. In the Preferred Embodiment, the transmitter/receiver elements operate to produce an output signal which varies between 4 and 20 milliamps, changing proportionally to the density or the amount of cryogen vapor outside enclosure 12, immediately adjacent the entrance opening 24 thereof. The electronic control unit 68 further includes a gain control module having an adjustment knob 55 for setting the blower output to an initial value. The blower system 30 may also have single speed or multiple speed windings, and the control unit will thus comprise only the gain control module. The fan control units for these latter blower systems are even less expensive, requiring only relay logic to switch the blower windings. However, even the relatively more costly fan control unit for the variable speed fan embodiment is considerably less expensive than a process controller, such as that typically used in temperature sensor-driven systems.

Preferably, the gain control module is of a type obtained from Wilkerson Instrument Co. Inc. of Lakeland Florida, under the name MIGHTY MODULE. The gain control module includes a differential amplifier which measures either a DC input voltage, or, with a shunt resister measures a current input. The preferred gain control module provides a DC output proportional to a DC input signal while providing wide ranging zero and span adjustments that allow the unit to accommodate a wide range of signal levels and offsets.

The gain control module provides an adjustment for the freezer operator to quickly and easily initialize the desired freezer operation. For example, when the cryogen input is established for a given product loading through the freezer, the gain control module can be adjusted to provide the desired outflow of cryogen vapor necessary to establish an air lock at the freezer entrance. Once the gain control module is initialized, blower output is thereafter automatically controlled in response to the input to control unit 68.

The output signal may be step-wise variable but preferably is continuously variable, with control unit 68 comparing the output signal to preselected "set points." For example, a pair of set points may be stored in control system 68, indicating excessive cryogen vapor leakage and an insufficient leakage to maintain a cryogen vapor barrier, respectively. The control system 68 responds to the sensor output signal on conductor 70, generating a control signal on conductor 74 connected to baffle motor 40 to provide a blower control signal thereto. In the preferred embodiment, the blower control signal varies from 0 to 115 volts, to drive the baffle motor 40 to an infinite number of control positions. As described in U.S. Pat. No. 4,783,972, the baffle motor 40 somewhat resembles a rotary stepper motor in operation, with various angular positions of the motor output shaft driving blower linkage throughout the range of motion illustrated in FIGS. 5–7. In response to the blower control signal, baffle motor 40 operates the linkages interconnecting the superior and inferior dampers at the upstream and downstream locations of baffle arrangement 36, producing, for example, the extreme operating conditions illustrated in FIGS. 5 and 7 and an intermediate operating condition illustrated in FIG. 6.

Figure 5:
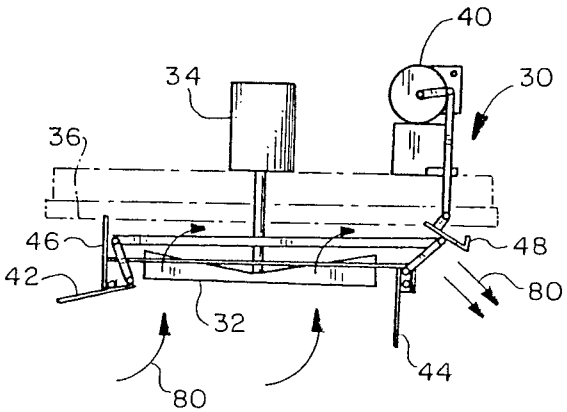
FIGS. 5–7 are fragmentary schematic views of a portion of the freezer apparatus of FIG. 4, illustrating its main blower and an associated baffle system which is used to control the flow of cryogenic vapor within the freezer apparatus, the baffle system being illustrated in different operating positions throughout the figures.
Figure 6:
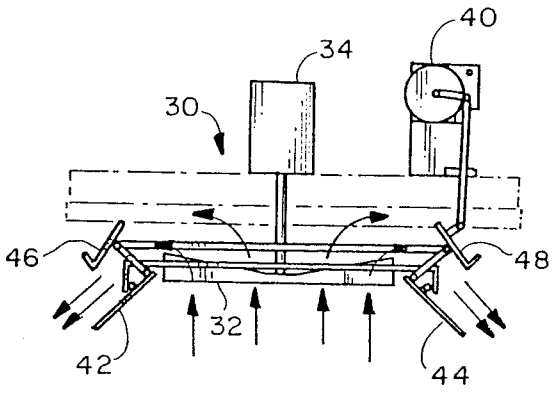
Figure 7:
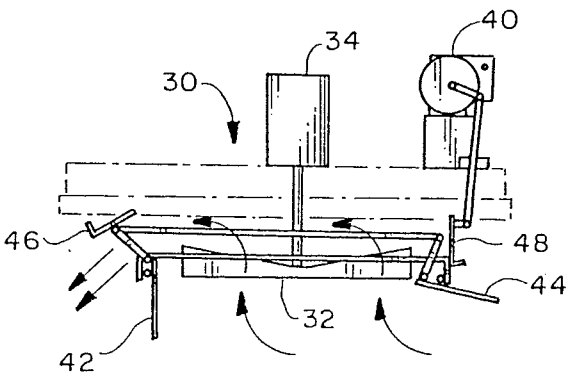
Figure 4:
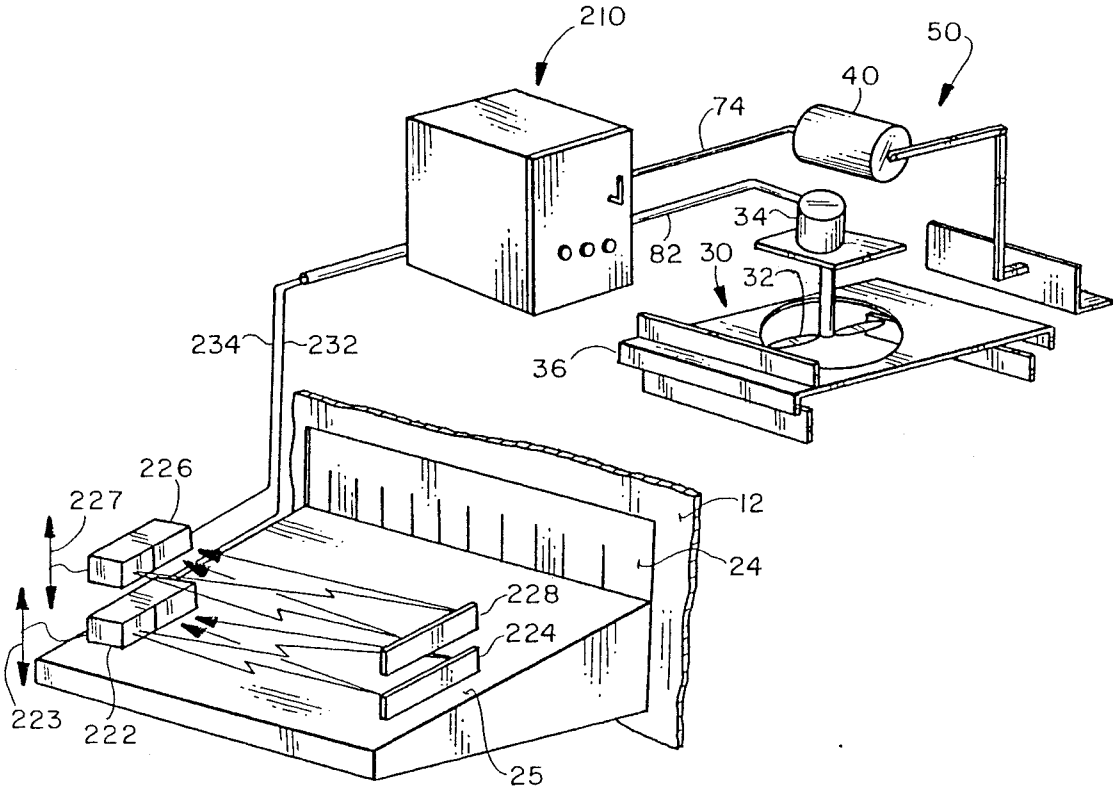
FIG. 4 is a schematic illustration of another embodiment of the vapor balance control and main blower systems used in the present invention.

Referring additorially to FIGS. 5–7, and assuming a cryogen immersion operation of the freezer apparatus, fan motor 34 is directed to rotate so fan 32 blows in an upward direction. Assuming a relatively dense discharge of cryogen vapor from enclosure entrance 24 (see FIG. 3), the signal between the sensor elements 62, 64 is more heavily attenuated or otherwise altered. The sensor output signal on conductor 70 is fed to control system 68 which preferably monitors the instantaneous signal condition and any trend in the change of the output signal. Assuming, for example, that control system 68 is provided with two set points as described above, and the output signal along conductor 70 is processed by the control system so as to fall outside, ,of the normal operating range, the control system then initiates operation of blower system 30 (see FIG. 3) to reduce the pressure and hence the discharge rate of cryogen vapor at the enclosure entrance.

In the Preferred Embodiment, control system 68 issues a blower control signal along conductors 74 causing the baffle actuator motor 40 to rotate to the position illustrated in FIG. 5. Linkage connected to motor 40 opens the upstream inferior damper 42 and the downstream superior damper 48, while closing the upstream superior damper 46 and the downstream inferior damper 44. Accordingly, cryogen vapor is circulated through blower arrangement 36 in the manner indicated by the arrows 80. In the operating position illustrated in FIG. 5, blower fan 32 applies a suction at the entrance to the enclosure drawing cryogen vapor from the interior of enclosure 12, adjacent the entrance opening 24. The cryogen vapor is then directed by the fan blade to the downstream direction, passing through the opened damper plate 48, and being discharged to pass over downstream portions of conveyor 18, thus providing a cooling benefit therefor. If the change in damper position alone is not adequate, the blower motor can be provided with variable speed capabilities or with multiple speed windings, and the control system 68 can be coupled to blower motor 34 through a conductor 82, as shown in FIG. 3. If a variable speed fan motor 34 is provided, it can be controlled by signals on conductor 82. However, a variable speed control circuit can be replaced by less expensive relay logic which switches the various windings of a multiple winding motor. In either event, the control unit 68 will include a gain control module which enables an operator to set the blower output to a desired level during startup, once the freezer operating conditions have been established. Thereafter, the blower output automatically tracks the cryogen injection rate. The gain control module therefore will be seen as providing an initial set point in the blower output. One advantage of this arrangement is that costly process controllers are not needed to obtain a highly accurate and precise vapor balance control.

If, upon further monitoring of the sensor output signal, the control system 68 has determined that the desired control range has not been achieved with a particular damper setting, the control signals on conductor 82 can be changed to drive blower motor 34 at a higher or lower speed (if such capability is provided), thereby adjusting the draw or suction of cryogen vapor from the interior of enclosure 12 adjacent entrance opening 24. Those skilled in the art will appreciate that a significant range of control can be provided using either reconfiguration of the baffle plate and/or the change in blower motor speed.

Control provided by the present invention prevents an inefficient use of cryogen material, while assuring the continued presence of a vapor barrier at the enclosure entrance (or other opening of the freezer enclosure). An over-correction will tend to reduce the cryogen pressure necessary to maintain an effective air lock or barrier to atmospheric intrusion. The control system 68 can be conventionally designed to apply correction to reduce cryogen pressure at the enclosure entrance in a slow, carefully controlled manner so as to avoid over-correction and temporary loss of the cryogen barrier protection.

Referring now to FIGS. 3 and 7, a second, extreme operating position of the baffle arrangement is shown. Assuming the sensor elements 62, 64 detect an absence of cryogen vapor outside the enclosure entrance 24 or detect an unacceptable low density of cryogen vapor, the output signal 70 from the sensors will relay the necessary information to control system 68 which will act to increase cryogen vapor pressure at the enclosure entrance. In the Preferred Embodiment, the sensor output signal 70 is continuously compared to a pair of preselected set point values. Upon excursion of the sensor output signal beyond a normal operating range, control system 68 applies a blower control signal on conductor 74 causing baffle motor 40 to move to the position illustrated in FIG. 7. Linkage connected to the baffle motor 40 causes the superior upstream baffle 46 and the inferior downstream baffle 44 to open, while closing the inferior upstream baffle 42 and the superior downstream baffle 48. As indicated by the arrows in FIG. 7, cryogen vapor is drawn from downstream portions of the freezer apparatus being directed upwardly through fan blade 32 to be discharged toward the enclosure entrance 24.

Optionally, if additional control is required, the fan motor 34 can be made of a variable speed type, receiving control signals from blower system 68 to further increase fan speed, providing additional cryogen vapor pressure at the enclosure entrance 24. The corrective action to elevate cryogen vapor pressure at the enclosure entrance continues, in the Preferred Embodiment, until sensor output signal on the conductor 70 passes a normal operating set point indicating the presence of a sufficient cryogen vapor pressure to maintain the desired barrier or air lock, preventing intrusion of ambient air into the freezer enclosure. As will become apparent to those skilled in the art, the rates of change in the sensor output signal can be monitored and various time delays can be incorporated in the control system 68 to provide nonlinear control output signals to achieve desired control, according to principles of system control which are well known in the art.

FIG. 6 shows an intermediate operating position of baffle system 30 wherein all dampers are in an open position, with cryogen vapor being drawn from the interior portion of the freezer enclosure, rather than the entrance end, and discharging cryogen vapor more or less uniformly throughout the enclosure interior, rather than directing a substantial portion of the fan output to the enclosure entrance.

The freezer apparatus mentioned thus far has a top-mounted blower system with an upward discharge, suitable for use with a tunnel freezer having a cryogen immersion bath at its upstream end, with cryogen liquid from the bath quickly being converted to a cryogen vapor which is distributed to downstream portions of the tunnel enclosure.

Figure 8:
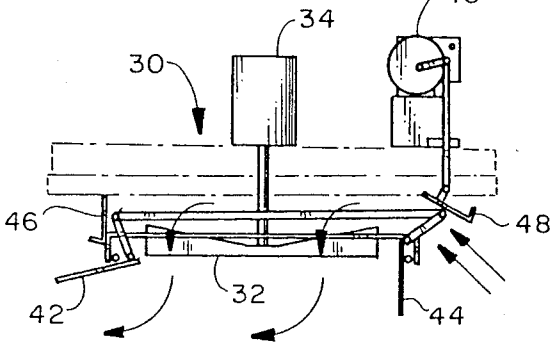
FIGS. 8–10 are fragmentary schematic views of the freezer apparatus of FIGS. 11 and 12 specifically illustrating its main blower and an associated baffle system which is used to control the flow of cryogenic vapor within the freezer apparatus, the baffle system being shown in different operating positions throughout the figures.
Figure 9:
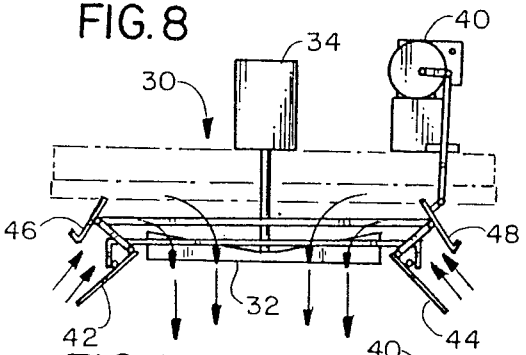
Figure 10:
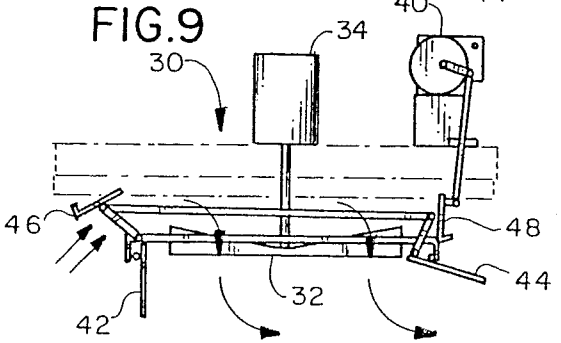

Referring now to FIGS. 8–10, freezer apparatus 10 described above can be adapted for so-called tunnel freezer operation in which the cryogen immersion bath is omitted. In this type of operation, the cryogen vapor for the freezer is provided by a direct impingement of the cryogen on the product to be cooled or frozen. Spray nozzles are employed adjacent the upstream enclosure wall in a manner described in U.S. Pat. Nos. 4,738,972, and 4,739,623, hereby incorporated by reference as if fully set forth herein. For this type of cryogen injection, freezer operation is benefited by a downward fan discharge, opposite to that illustrated in FIGS. 5–7. As will be seen by comparing FIGS. 5–7 with FIGS. 8–10, the physical orientation of the various baffle dampers is the same, although due to the reversal in fan direction, different results in the vapor barrier at the enclosure entrance are achieved.

It will be readily appreciated that the same operating positions of the baffle arrangement with fan 32 blowing in a downward direction are also effective to insure an adequate cryogen pressure barrier at the enclosure entrance, without an inefficient discharge of excessive amounts of cryogen vapor to the atmosphere.

For example, with reference to FIG. 3, if an inadequate cryogen pressure is sensed by elements 62, 64, their output signal is acted upon by a control system 68 to energize baffle motor 40 to configure the baffle arrangement to the orientation illustrated in FIG. 8. With fan discharge in a downward direction, suction is applied through the downstream superior baffle 48 being discharged in a direction guided by the inferior upstream baffle 42, toward the enclosure entrance. Conversely, if an excessive, inefficient discharge of cryogen vapor is sensed, control system 68 drives baffle motor 40 to the position illustrated in FIG. 10, causing cryogen vapor to be drawn through the superior upstream baffle 46, the fan discharge being directed by downstream inferior baffle 44 to provide useful cooling to product carried on downstream portions of conveyor belt 18. FIG. 9 shows an intermediate "balanced flow" position.

Figure 11:
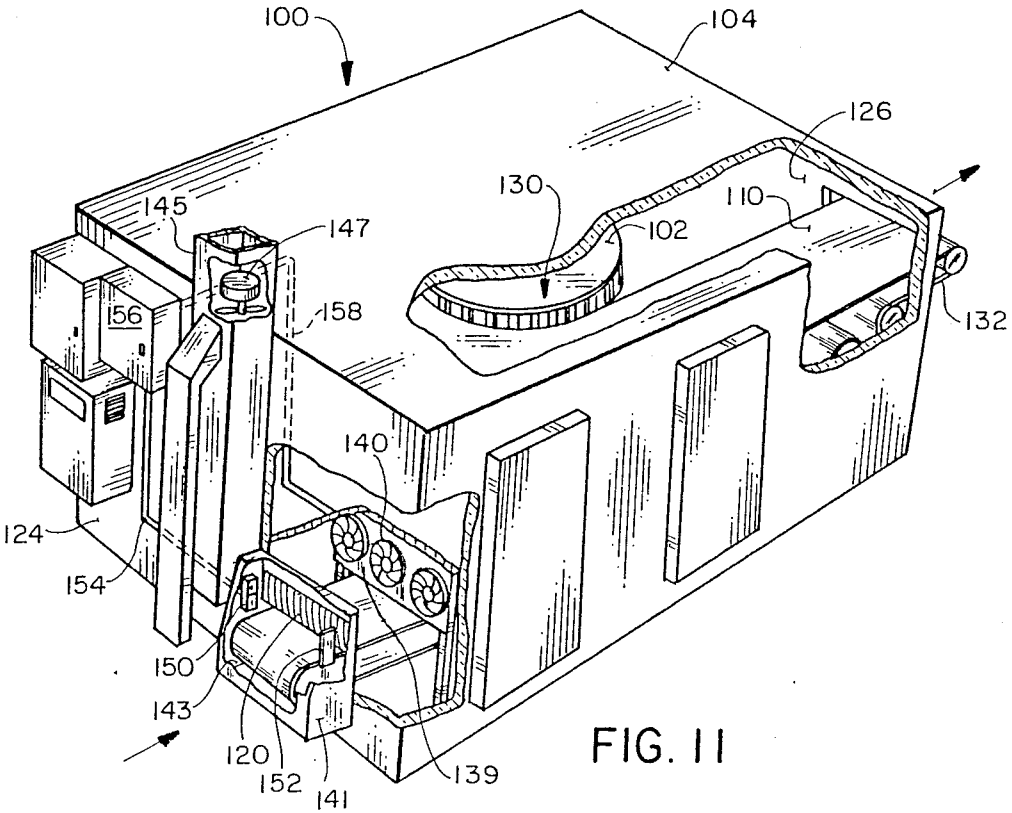
FIG. 11 is a perspective view of a second preferred embodiment of a freezer apparatus according to the present invention, using a spiral endless conveyor for transporting products through the freezer apparatus.
Figure 12:
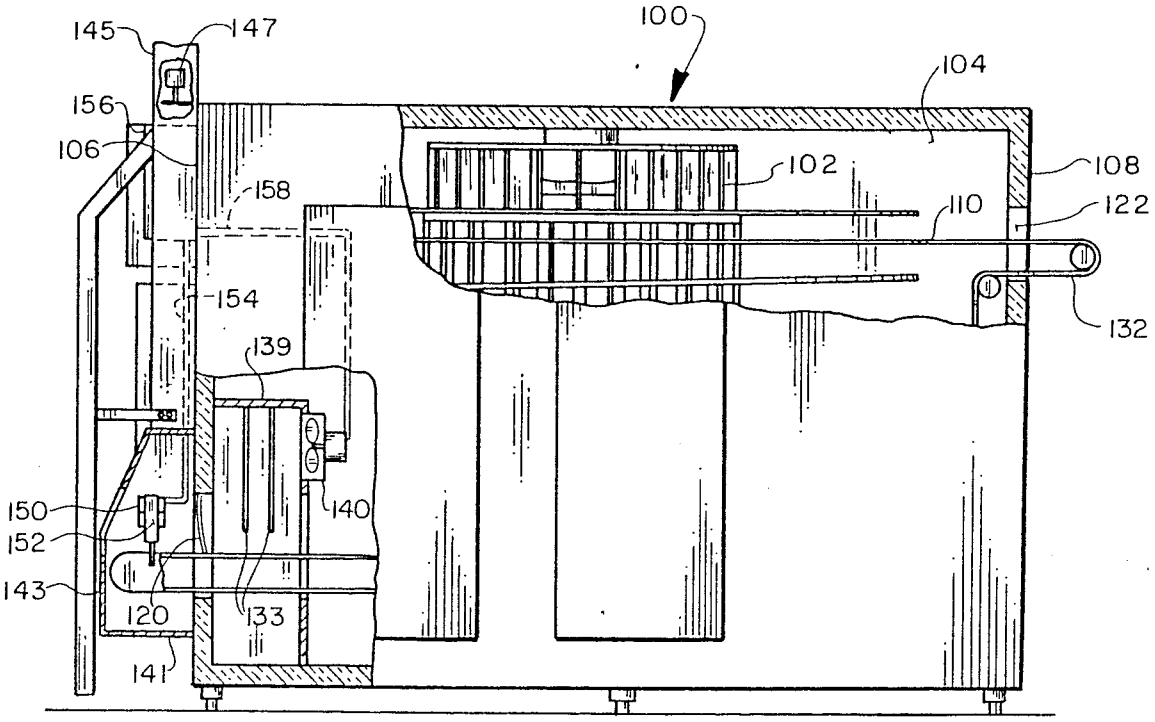
FIG. 12 is a cross-sectional view of the apparatus of FIG. 11.

The above-described freezer apparatus 10 is adapted for use with a linear conveyor which traverses a generally straight-line path between entrance and exit openings of the freezer enclosure. With reference to FIGS. 11 and 12, the automatic vapor balance control achieved by the present invention is also applicable to other types of freezer arrangements, such as the helical conveyor freezer apparatus generally indicated at 100. A helical conveyor 102 is disposed within an insulated enclosure 104. Enclosure 104 has an entrance end 106 and an exit end 108. The helical conveyor 102 includes an endless conveyor belt 110 which protrudes through entrance and exit openings 120, 122 formed in the entrance and exit walls 124, 126, respectively of enclosure 104.

The conveyor belt 110 is stacked in a series of successive helical coils located at the center of the freezer apparatus, the stack being designated generally by the reference numeral 130. The conveyor belt enters stack 130 from below and after a succession of helical turns, exits the top of stack 130 as can be seen in FIGS. 11 and 12. After briefly exiting enclosure 104, conveyor belt 110 enters a return loop 132 continuing on through the entrance opening 120 of the enclosure. Other details concerning the conveyor arrangement and the enclosure 104 can be found in commonly assigned U.S. Pat. No. 4,739,623, the disclosure of which is incorporated by reference as if fully set forth herein. The enclosure, including the cryogen cooling systems and various blower systems of apparatus 100, are substantially identical to those disclosed in U.S. Pat. No. 4,739,623; however, an exhaust plenum located on entrance wall 124, generally above entrance opening 120, has been omitted from FIG. 11 for purposes of clarity.

Located in enclosure 104, behind entrance opening 120 is a series of baffles 133 (see FIG. 12), communicating with a plenum or housing 139 which surrounds a portion of conveyor belt 110 which has passed entrance opening 120. One or more blowers 140 are mounted in housing 139, providing air flow communication between housing 139 and the interior chamber of enclosure 104. The blowers may have single or multiple speed windings, or they may be of the variable speed type.

A set of sensor elements 150, 152 is disposed outside of enclosure 104 immediately adjacent entrance opening 120, being laterally spaced from one another, lying on either lateral side of conveyor belt 110. The sensor elements 150, 152 can comprise any type of commercially available transmitter/receiver sets which send a signal across conveyor belt 110 at a point close to the conveyor surface, adjacent the entrance opening 120. In the Preferred Embodiment, sensor element 150 comprises a photocell transmitter/receiver component and sensor element 152 comprises a reflector element. The preferred photocells respond to infrared signals, and are employed to detect moisture condensed in the cold cryogen vapor. Alternatively, sensor element 152 can comprise a radiation transmitter and sensor element 150 can comprise a radiation receiver.

In either event, the output from the receiver portion of the sensor elements is transmitted along conductor 154 to a control unit 156. Control unit 156 sends an output signal on conductors 158 to control the output of blowers 140. The sensor elements 150, 152, the conductors 154, 158 and the control unit 156 are similar in construction and operation to corresponding components 62, 64, 70, 74 and 68 described above with reference to FIGS. 1–3. For example, if sensor elements 150, 152 detect excessive discharge of cryogen vapor from the interior of the freezer enclosure, control system 156 issues blower control signals on conductor 158 to increase the blower output into the freezer enclosure, drawing vapor from housing 139. The housing 139 is baffled at 133 to retard outflow of cryogen through entrance opening 120. The baffles 133 can be adjusted in height to accommodate products of different height.

The output of blowers 140 are adjusted as necessary to reduce the discharge of cryogen vapor through entrance opening 120, eliminating excessive cryogen outflow beyond that necessary to maintain an air lock at the enclosure entrance. If, however, sensors 150, 152 detect an unacceptable decrease in cryogen vapor discharge, their sensor output signal on conductor 154 is processed by control unit 156 which issues a blower control signal on conductor 158. This reduces the speed of blower 140 which discharges into enclosure 104 (so as to reduce the suction withdrawing vapor away from entrance opening 120).

In the Preferred Embodiment, the sensors 150, 152 operate to provide a continuously variable output signal, with control system 156 continuously reading that output signal and comparing the signal to preselected threshold values and optionally noting the rate of change of the sensor output signal. The control unit 156 can be made even more economical for blowers having single speed or multiple speed windings. For example, the blowers 140 can be provided with multiple speed windings, so that the control unit would require only relatively inexpensive relay logic (in addition to the aforementioned gain control module) to control the blower output over an operating range. Relay logic can also be employed to provide a "staging" control of the several blowers, turning additional blower units on and off as required to obtain the desired vapor balance at the freezer entrance opening.

Figure 13:
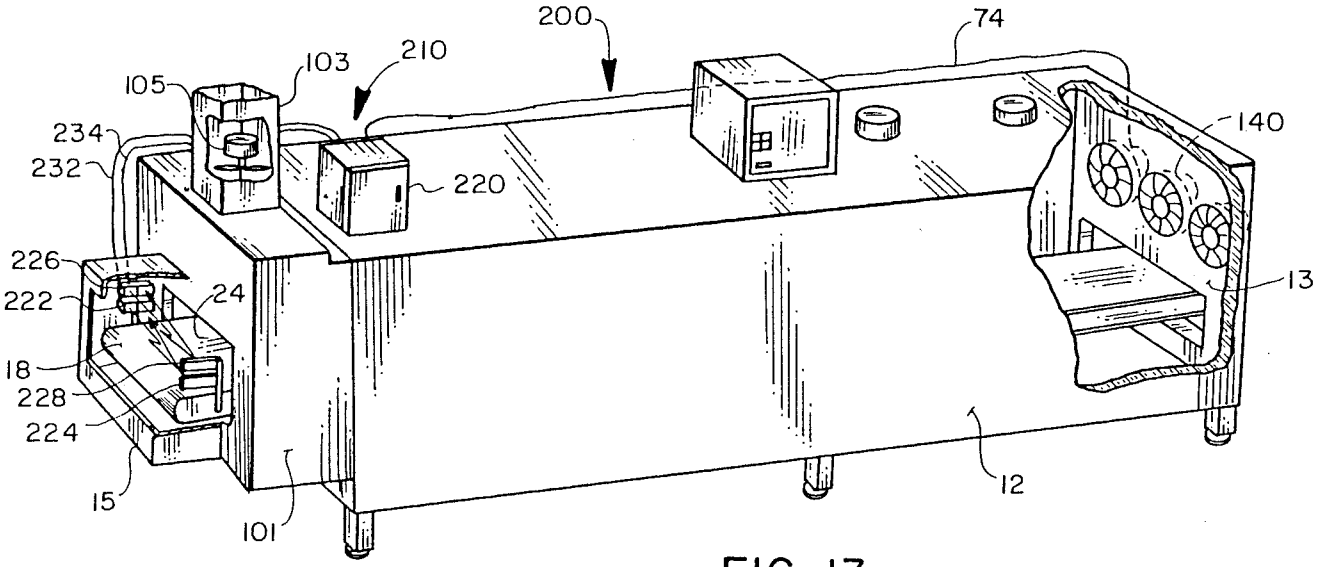
FIG. 13 is a perspective view of another preferred embodiment of a freezing apparatus according to the present invention having a freezing tunnel through which products are transported for freezing.
Figure 14:
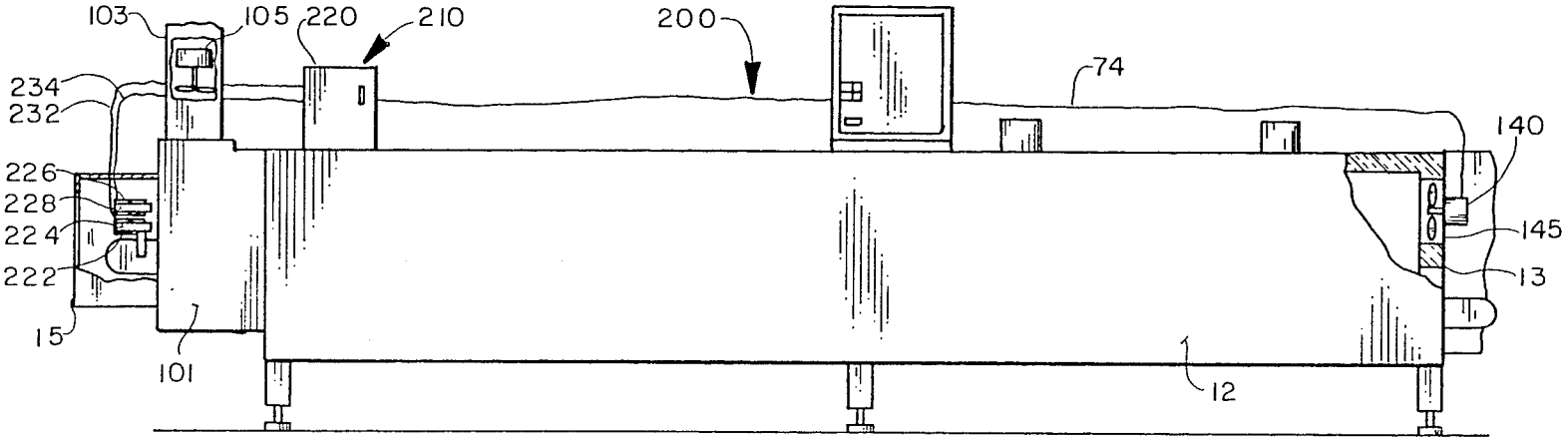
FIG. 14 is a side-elevational view, shown partly broken away, of the apparatus of FIG. 13.
Figure 15:
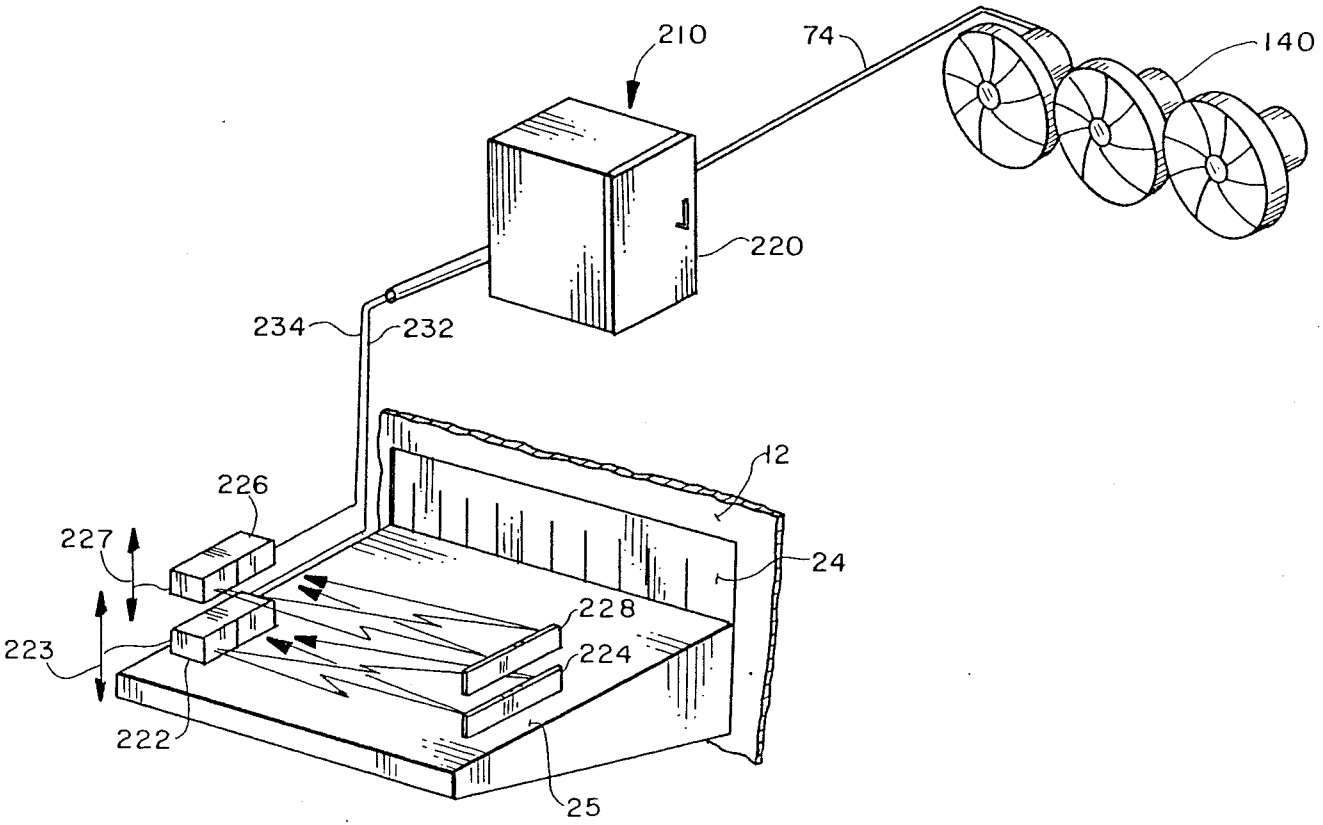
FIG. 15 is a fragmentary perspective view of the control system of FIGS. 13 and 14.

Turning now to FIGS. 13–15, another Preferred Embodiment of the present invention will be described with reference to a freezer apparatus generally indicated at 200. The freezer apparatus 200 includes an enclosure 12 identical to the enclosure described above with reference to FIGS. 1 and 2. One difference is that the freezer apparatus of FIGS. 13–15 employs different blowers, mounted on the rear enclosure wall 13. In one practical application, the freezer apparatus is mated to a downstream freezer, such as a mechanically cooled unit. Thus, the freezer of FIGS. 13–15 has a different commercial application than the stand-alone operation of the freezer shown in FIGS. 1 and 2. The blowers 140 of freezer apparatus 200 are mounted at the transition between the mated freezer units.

Apparatus 200 employs a conveyor identical to that described above with reference to FIGS. 1 and 2. A control system is generally indicated at 210, and as will be seen herein, includes, in one embodiment, components similar to those of the control system 30 described above, except for the number and operation of sensor elements adjacent the entrance opening 24. More particularly, the control system 210 includes a gain control module of the type described above and blower control circuitry of the relay logic type, preferably staging the blowers 140, to provide incremental control over the blower output.

According to one aspect of the present invention, this Preferred Embodiment includes two pairs of sensor elements located outside of the freezer enclosure, immediately adjacent the entrance opening 24. A first pair of sensor elements 222, 224 are located below the second pair of sensor elements 226, 228. Each pair of sensor elements straddles the width of conveyor 18 with one element from each pair being located near one lateral edge of the conveyor. Each pair of sensor elements passes a test signal above the conveyor to measure the amount of cryogen vapor at the enclosure entrance.

According to one aspect of the present invention, the pairs of preferred sensor elements differ only in their physical location, one pair being located above the other. Because cryogen vapor is heavier than the ambient surrounding the freezer apparatus, a thin blanket of cryogen vapor will tend to "sink", being sensed first by the lower pair of sensor elements, 222, 224. A vapor dam 15 may be located adjacent the entrance opening to collect the vapor. As the amount of cryogen vapor flowing out of the enclosure opening increases, the ceiling or uppermost surfaces of the cryogen vapor blanket are upwardly displaced due to the thickening of the cryogen vapor layer. Eventually, the cryogen vapor rises to interfere with the signal passed between the upper pair of sensor elements, 226, 228.

According to one aspect of the present invention, when two pairs of sensor elements are employed in the manner described above, less costly sensor elements can be used. For example, the sensor elements 222, 226 can comprise photocell transmitter/receiver components with their counterpart elements 224, 228 comprising reflectors. Signals from the receiver portions of elements 222, 226 are carried on conductors 232, 234 to control unit 220.

The elements described above with respect to the preceding embodiments, provide a continuous sensitivity throughout the sensor's operating range, thus outputting a continuously varying signal indicating changes in the amount of cryogen vapor detected. When two pairs of sensor elements are employed at the enclosure entrance, the sensor elements can comprise "on/off" or bistable devices which respond only when an inherent threshold of the sensor element is passed. For example, when the elements 222, 226 comprise photocell transmitter/receiver devices, the elements function as "on/off" devices being triggered when a preselected quantity of cryogen vapor passes between the element pairs.

The element 222, for example, has a "turn on" threshold responding to a predetermined change in its reference signal, achieved when a precise amount of cryogen vapor passes between the elements 222, 224. Assuming a rising level of cryogen vapor exiting enclosure entrance 24, the element 222 will "turn on" or toggle, sending an "on" signal on conductor 232 to control unit 220. Preferably, this signal indicates a satisfactory amount of cryogen vapor flowing out of enclosure entrance 24, predetermined to be necessary to provide the required air lock to prevent ambient intrusion into the enclosure entrance.

The sensor elements 222, 224 have an inherent sensitivity and will "turn off," thereby toggling the signal on conductor 232 when the amount of cryogen vapor passing between the bottom elements falls below a certain level. By selecting this "turn off" level, a toggling of the signal on conductor 232, indicating an "off" condition of the sensor elements, can be used to provide an indication of insufficient cryogen vapor at the enclosure entrance needed to establish an effective air lock. Thus, the first pair of sensor elements 222, 224 can be employed to determine whether or not a minimum amount of cryogen vapor is present at the enclosure entrance.

Assuming that the cryogen vapor exiting the enclosure entrance is sufficient to establish an air lock at the enclosure entrance to prevent intrusion of the ambient into the freezer enclosure, additional amounts of cryogen vapor exiting the opening 24 will not contribute further to the freezer operation and will represent an inefficient use of the cryogen employed. While the sensor elements 222, 224 could be of a type which output a continuously varying signal, exhibiting sensitivity over any condition that might occur during freezer operation, it is preferred in the second embodiment that the sensor elements 222, 224 comprise "toggling" ("on/-off") devices.

Accordingly, the first pair of sensor elements 222, 224 will not be able to detect an excess cryogen vapor discharge, beyond that needed to provide an effective air lock. There is accordingly provided a second pair of sensor elements 226, 228 spaced above the first pair of sensor elements a preselected distance corresponding to the range of cryogen vapor discharge that is desired for a particular system. The second pair of sensor elements 226, 228 functions the same as the first pair of sensor elements 222, 224 and, if desired, could be identical thereto.

As mentioned, cryogen vapor is heavier than the ambient surrounding the freezer apparatus, and accordingly, tends to "sink" onto the conveyor, forming a blanket covering the conveyor. As the amount of cryogen vapor increases, the height or thickness of the blanket increases the upper surface of the cryogen blanket, rising higher and higher with increasing discharge amounts. The first pair of sensor elements 222, 224 can be spaced above the conveyor by a distance corresponding to a cryogen vapor blanket thickness, insuring adequate air lock at the enclosure entrance. The first pair of sensor elements are preferably mounted for vertical adjustment in the direction of double-headed arrow 223. The second pair of sensor elements 226, 228 are spaced above the first pair of sensor elements to detect the upper extent of a maximum blanket thickness that is desired under normal freezer operation. The second pair of elements are also vertically adjustable in the direction of double-headed arrow 227.

Accordingly, as the amount of cryogen vapor exiting enclosure entrance 24 increases beyond a maximum acceptable level, the upper extent of the cryogen vapor blanket will rise to interfere with the signal passing between upper sensor elements 226, 228, thus toggling the output signal on conductor 224 indicating that a maximum normal cryogen vapor discharge has been attained. Those skilled in the art will readily appreciate that, with relatively simple, inexpensive sensor element pairs, a high level of accuracy can be attained, with thresholds easily being reset by altering the spacings of the sensor element pairs above the conveyor.

A control unit 220 monitors signals on conductors 232, 234 looking for the signals on those conductors to toggle. Assuming a start up operation with no cryogen vapor initially present, the signals on both conductors 232, 234 will indicate an "off" condition. Since an air lock is not present at the enclosure entrance, the control system 210 will reconfigure the blower system to attain the necessary cryogen vapor outflow from opening 24 as quickly as possible. The control unit 220 will issue blower control signals on conductor 74, energizing blowers 140. The blower control signals preferably turn incremental numbers of blowers 140 on and off as required. Although blowers having variable speed capability can be used, such are not preferred, due to cost savings for control systems which require only simple relay logic, rather than more costly process controllers, or continuous output circuits which provide a continuously variable signal.

Cryogen vapor generated by spraying product with liquid cryogen is drawn downstream through the enclosure by blowers 140. As the freezer apparatus begins to cool down, a build up of cryogen vapor will occur in the enclosure and increasing amounts of cryogen vapor will be available at the enclosure entrance. Initially, cryogen vapor leaving entrance 24 will fall on conveyor 18 to form a relatively thin blanket layer. As the cryogen layer builds up in the enclosure and is therefore made available for an outflow through opening 24, the blanket increases in thickness and eventually interferes with the signal path between sensor elements 222, 224. At this point, the output signal on conductor 232 will toggle to a "on" position, indicating that a necessary threshold of cryogen vapor outflow has been attained.

Eventually, with increasing amounts of cryogen vapor exiting opening 24, the cryogen vapor blanket will increase in thickness to a point where the signal between the upper pair of sensors 226, 228 is affected. The sensors will cause the output signal on conductor 234 to toggle to an "on" position. Control unit 220 will thereupon be notified that a maximum acceptable cryogen vapor outflow has been attained. The control unit 220 can immediately take action to reduce cryogen vapor pressure at the entrance portion of the enclosure, or can activate a time delay circuit to prevent "hunting" of the control system.

Either immediately or after a sufficient time delay, control unit 220 issues further commands on conductor 74, reducing the output of blowers 140. It may be desirable, in some applications, to leave one of the blowers energized at all times, with the remaining blowers being toggle on and off as required.

Thus, as before, the control unit causes the cryogen injection and blower fan outputs to be related to one another, that is, to "follow" one another.

As can be seen from the above, when cryogen injection is, increased as dictated by circuitry, to attain desired operating conditions within the freezer unit, the fan output of blower fans 30 is automatically and correspondingly increased, thereby increasing the vacuum or suction at the freezer entrance 24. As will be appreciated by those skilled in the art, the amount of increased suction at the freezer entrance 24 can be accurately controlled so as to prevent excessive outflow, or purge, of cryogen vapor through entrance 24. The fan output of blower fans 30 can be easily controlled with the gain control module so as not to "overpower" cryogen vapor pressures at entrance 24 to a point where those pressures fall below the ambient air pressure at the freezer entrance, thus insuring that a cryogen vapor purge, or air-lock, at the freezer entrance will be provided at all times.

By increasing the blower fan output along with increased cryogen injection, the most efficient utilization of the added cryogen vapor is attained, by directing that vapor toward the coil stack and the conveyor belt 18 where useful work is done in cooling or freezing products to be processed by the freezer system. As the freezer enclosure cools down to a desirable temperature, the pressure in the cryogen injection lines 34 is reduced, and accordingly, the blower fan output is also reduced to prevent the intrusion of ambient air through entrance 24.

The control system, according to the present invention has been found to provide the flexibility necessary to offer efficient cryogen usage in a variety of applications, such as the spiral freezer illustrated in FIGS. 2–13. As will be seen herein, the same control system is also readily adaptable for use with a tunnel freezer of FIGS. 1–10, operated as a stand-alone freezing unit, and a tunnel freezer illustrated in FIGS. 13–15 providing an initial cooling at the entrance to a mechanical freezing unit.

Referring again to FIGS. 13–15, one commercially important application of the tunnel freezer 200 is to provide added cooling capacity for a mechanical freezer, one using ammonia or FREON as the cooling medium, for example. The cooling apparatus generally indicated at 200 preferably is provided with a mating surface 145 at transition wall 13 for coupling to a downstream freezer apparatus, usually of the spiral conveyor type. The blowers 140 may be located in a chamber at the enclosure entrance constructed in a manner similar to the enclosure 139 illustrated in FIG. 12. Any cryogen vapor passing completely through tunnel apparatus 200 now enters the mechanically cooled freezer enclosure, providing additional cooling therefor. The contribution to overall operating efficiency for downstream freezer apparatus by tunnel freezer 200, and the automatic vapor balance control loop system therein, makes the retrofit application of the tunnel freezer economically advantageous.

Control of the blowers 140 follows the same principles described above, particularly those described with reference to the spiral freezer apparatus 100 of FIGS. 11 and 12. In particular, a gain control module is employed to establish initial vapor outflow conditions during freezer start up. Once the desired freezer operation is established, the gain control module is adjusted to provide the desired amount of cryogen outflow at tunnel freezer entrance 24. If variable speed blowers are employed, the fan control unit 220 generates a continuously varying signal proportional to the injection signal of the cryogen injection system of the tunnel freezer 102.

The signal driving fan control unit 220 can be obtained from the temperature controller for the tunnel freezer, that control system providing an injection control signal in response to the output of a temperature sensor. It is possible, however, to construct a more economical fan control unit if blower motors having either signal or multiple speed windings are used. In addition to a gain control module, the fan control unit of this latter embodiment would comprise relay devices for switching the windings of the blower motors to obtain different blower output levels. For example, the multiple blowers 140 can be "staged" with incremental switching logic.

As described in the various embodiments above, blower units located within the freezer enclosure are controlled to regulate the cryogen vapor outflow through the freezer enclosure entrance. It will be readily appreciated by those skilled in the art that the principles of the present invention can also be applied to the control of "roof vents," a term describing exhaust vents located adjacent the entrance and/or exit openings of the freezer enclosure. For example, the present invention is also directed to control of the blowers providing "roof venting" of tunnel freezers, such as the freezers illustrated in FIGS. 1 and 13. As shown at the entrance end of FIG. 1, a collection chamber 101 surrounds the entrance end of the freezer and a chimney 103 communicates with chamber 101 to apply a suction thereto. The output of fan control unit 68 can be connected to roof vent blower 105 either in combination with or to the exclusion of blower system 30. If blower system 30 is omitted, the output of fan control unit 68 is directed exclusively to roof vent blower 105 to control the cryogen vapor outflow through entrance opening 24. If desired, however, blower system 30 can be used in conjunction with the roof vent blower 105, all being controlled by fan control unit 68.

The same principles can be applied to the tunnel freezer apparatus 200 for mated combination applications. The roof vent blower 105 can be operated in combination with, or to the exclusion of, blowers 140. Thus, as before, the control unit 68 causes the cryogen injection and blower fan outputs to be related to one another, that is, to "follow" one another in response to a common input signal, herein the signal from the set(s) of vapor detectors located outside the enclosure, adjacent the entrance opening thereof.

The roof vent vapor control principles described above can also be applied to spiral freezers. Referring again to FIG. 11, a "spill over" chamber 141 is provided to surround the enclosure entrance. An opening 143 in the spill-over chamber is aligned in registry with the enclosure entrance opening 120, allowing product to be passed therethrough. Because cryogen vapor is heavier than air, vapor "spilling out" of the entrance opening of the enclosure will fall into chamber 141, being collected there rather than spreading throughout the operating area. A "chimney" 145 evacuates or purges chamber 141. The blowers 147 applying a suction to chimney 145 are commonly referred to as part of the "roof vent" system. If desired, blowers 140 disposed within the freezer enclosure can be omitted, with vapor balance control according to the present invention being provided by the application of control signals to the blower 147 applying a suction to chimney 145.

The above are examples of roof vent blower control for a spiral freezer (FIG. 11) for tunnel freezers for a stand-alone application (FIG. 1) and for a combination freezer application (FIG. 13). If desired, however, the vapor balance control of the present invention can also be provided with the other freezer apparatus described herein. In each application, the fan control unit, including a gain control module, will be connected either to the roof vent blower, blowers internal to the freezer enclosure, or both. In addition, those skilled in the art will readily appreciate that roof vents can be provided at any opening of the freezer enclosure, notably the exit openings.

It will now be seen that the various vapor balance control systems provided by the present invention receive input signals directly related to cryogen injection, rather than exhaust temperature. For example, input to the vapor balance control is obtained either from the cryogen injection signals of a freezer controller, or from pressure signals attained from the cryogen injection system. The fan output is thereby made to more directly track the cryogen injection rate, rather than a change in exhaust temperature which lags there behind, sometimes at a considerable time delay interval.

Gain control is provided to set an initial cryogen vapor outflow. However, the cost of such gain control apparatus is not considerable, and does not detract from the economical advantages obtained with the present invention. Further, with the present invention, a fan control unit can comprise relatively inexpensive relay logic if single speed or multiple speed windings are employed in the blower motors. However, even if the blower motors have a continuously variable speed output, the fan control circuitry needed to adapt cryogen injection control signals is still rather inexpensive, especially compared to process controllers such as those that would be required for a temperature-driven control of the freezer blowers.

Described above are fan control units having single and double sets of sensor elements. Either fan control unit can be used with tunnel or spiral freezers, whether of the immersion type or not, and regardless of the type of blower unit employed to direct cryogen vapor through the freezer enclosure or to suction vapor exiting an enclosure opening. Various examples of the freezer constructions, blower systems, and fan control units have been given above, and each can be interchanged with the other.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A cryogenic freezer apparatus for food products, comprising:

a thermally insulated enclosure having at least an entrance opening and an exit opening;

conveyor means for conveying products through said enclosure, from said entrance opening to said exit opening;

cryogen means in said enclosure for producing cryogen vapor near one of said enclosure openings;

blower means associated with said enclosure and selectively operable in response to a blower control signal to selectively apply different levels of suction adjacent said one enclosure opening to direct differing amounts of cryogen vapor away therefrom;

photocell means outside said enclosure, generally adjacent said one enclosure opening for detecting cryogen vapor exiting said one enclosure opening and for generating at least one sensor output signal in response thereto, said at least one sensor output signal being indicative of the amount of cryogen vapor flowing out of said one opening; and blower control means coupled to said photocell means and to said blower means for generating a blower control signal in response to said at least one sensor output signal, so that, with increasing vapor detected outside said one opening of said enclosure, the blower means increases suction of cryogen vapor away from said enclosure opening, so as to limit the outflow of cryogen vapor passing through said one enclosure opening to about a preselected amount needed to prevent intrusion of the ambient environment through said one enclosure opening, despite increasing volume of cryogen vapor generated in said enclosure, and so that output of the blower means is decreased with decreasing cryogen injection to ensure that at least about the preselected cryogen outflow is maintained at said one opening to prevent intrusion of the ambient environment therethrough.

2. The apparatus of claim 1 wherein said photocell means comprises a single photocell with proportional sensing disposed adjacent said enclosure opening, with means for generating a varying sensor output signal in proportion to the amount of vapor detected.

3. The apparatus of claim 1 wherein said control means generates a varying blower control signal in response to the sensor output signal causing said blower means to draw varying amounts of cryogen vapor in response thereto.

4. The apparatus of claim 1 wherein said photocell means comprises first, lower, and second, upper photocell means, spaced one above the other outside said enclosure adjacent the opening thereof, for detecting cryogen vapor escaping out of said opening and for generating first and second electrical signals, when cryogen vapor is detected at lower and upper portions of said opening, respectively.

5. The apparatus of claim 1 wherein said blower means includes baffle means which are selectively reconfigurable in response to a blower control signal to selectively draw blower suction from varying directions, drawing cryogen vapor away from a first portion of said enclosure and blowing cryogen vapor toward a second portion of said enclosure, so that, with increasing vapor detected outside the opening of said enclosure, the baffle means is directed to draw cryogen vapor away from said enclosure opening, so as to reduce the amount of cryogen vapor escaping through said enclosure opening, and so that, upon detecting a decreasing amount of cryogen vapor escaping from the opening of said enclosure, the baffle means is directed to suction cryogen vapor from the enclosure, blowing cryogen vapor toward the enclosure opening to assure that intrusion of the ambient environment through the enclosure opening is prevented.

6. The apparatus of claim 5 wherein said enclosure comprises a tunnel, and said blower means is located above said conveyor means and draws cryogen vapor from below, directing blower discharge in at least one of said directions toward the enclosure opening and toward downstream portions of said conveyor means.

7. The apparatus of claim 6 wherein said freezer apparatus further includes a cryogen immersion bath adjacent said blower means, with said blower means drawing cryogen vapor produced by said immersion bath.

8. The apparatus of claim 5 wherein said enclosure comprises a tunnel, and said blower means is located above said conveyor means and discharges cryogen vapor therebelow, drawing cryogen vapor from at least one of said directions toward the enclosure opening and toward downstream portions of said conveyor means.

9. The apparatus of claim 8 wherein said freezer apparatus further includes a cryogen spray adjacent said blower means, with said blower means drawing cryogen vapor produced by said spray.

10. The apparatus of claim 5 wherein said photocell means comprises a single photocell with proportional sensing disposed adjacent said enclosure opening, with means for generating a varying sensor output signal in proportion to the amount of vapor detected.

11. The apparatus of claim 5 wherein said control means generates a varying blower control signal in response to the sensor output signal causing said blower means to draw varying amounts of cryogen vapor in response thereto.

12. The apparatus of claim 5 wherein said photocell means comprises first, lower, and second, upper photocell means, spaced one above the other outside said enclosure adjacent the opening thereof, for detecting cryogen vapor escaping out of said opening and for generating first and second electrical signals, when cryogen vapor is detected at lower and upper portions of said opening, respectively.

13. The apparatus of claim 1 wherein said blower control means includes a gain control means for initial adjustment of said blower means to produce a preselected cryogen outflow out of said opening, said blower control means thereafter automatically responding to said cryogen control signal.

14. The apparatus of claim 13 wherein said photocell means comprises a single photocell with proportional sensing disposed adjacent said enclosure opening, with means for generating a varying sensor output signal in proportion to the amount of vapor detected.

15. The apparatus of claim 13 wherein said control means generates a varying blower control signal in response to the sensor output signal causing said blower means to draw varying amounts of cryogen vapor in response thereto 16. The apparatus of claim 13 wherein said photocell means comprises first, lower, and second, upper photocell means, spaced one above the other outside said enclosure adjacent the opening thereof, for detecting cryogen vapor escaping out of said opening and for generating first and second electrical signals, when cryogen vapor is detected at lower and upper portions of said opening, respectively 17. A cryogenic freezer apparatus for food products, comprising:

a thermally insulated enclosure having at least an entrance opening and an exit opening;

conveyor means for conveying products through said enclosure, from said entrance to said exit openings;

cryogen means in said enclosure for producing cryogen vapor near one of said enclosure openings;

blower means associated with said enclosure and selectively operable to selectively withdraw differing amounts of cryogen vapor away from the vicinity of said one enclosure opening as a mixture with ambient air;

photocell means comprising at least one photocell disposed generally adjacent said one enclosure opening, for detecting the amount of cryogen vapor exiting said one enclosure opening by monitoring the amount of condensed water vapor in said withdrawn mixture;

blower control means coupled to said photocell means for generating a blower control signal to control the blower means.

18. The apparatus of claim 17 wherein said blower means includes baffle means which are selectively reconfigurable in response to a blower control signal, said apparatus further comprising generated blower control means associated with said photocell means to selectively draw cryogen vapor from varying directions, so that, when an amount of cryogen is detected exiting said one enclosure opening, said the baffle means is automatically directed to draw cryogen vapor away from said one enclosure opening so as to reduce the amount of cryogen vapor exiting through said one enclosure opening.

19. A cryogenic freezer apparatus for food products, comprising:

a thermally insulated enclosure having at least an entrance opening and an exit opening;

conveyor means for conveying products through said enclosure, from said entrance to said exit openings;

cryogen means in said enclosure for producing cryogen vapor near one of said enclosure openings;

blower means associated with said enclosure adjacent said one opening, selectively operable in response to a blower control signal to selectively apply different levels of suction adjacent said one enclosure opening to withdraw differing amounts of cryogen vapor away therefrom;

a photocell unit comprising first, lower, and second, upper photocell means, spaced one above the other outside said enclosure in a passageway communicating with a region adjacent said one opening, for detecting cryogen vapor exiting said one enclosure opening and for generating first and second electrical signals, when cryogen vapor is detected at lower and upper portions of said passageway, respectively, said sensor output signals being indicative of the amount of cryogen vapor flowing out of said one opening; and blower control means coupled to said photocell means and to said blower means for generating a blower control signal in response to said sensor output signals, so that, with increasing vapor detected outside said one opening of said enclosure, the blower means increases suction of cryogen vapor away from said one enclosure opening, so as to limit the outflow of cryogen vapor passing through said enclosure opening to a preselected amount needed to prevent intrusion of the ambient environment through said one enclosure opening, despite increasing volume of cryogen vapor generated in said enclosure, and so that output of the blower means is decreased with decreasing cryogen injection to ensure that the preselected cryogen outflow is maintained at said one opening to prevent intrusion of the ambient environment therethrough.

20. The apparatus of claim 17 wherein said blower means includes baffle means which are selectively reconfigurable in response to a blower control signal to selectively draw cryogen vapor in varying directions, so that, with increasing vapor detected outside the opening of said enclosure, the baffle means is directed to draw cryogen vapor away from said enclosure opening, so as to reduce the amount of cryogen vapor escaping through said enclosure opening, and so that, upon detecting a decreasing amount of cryogen vapor escaping from the opening of said enclosure, the baffle means is directed to lesser amounts of cryogen vapor away from the enclosure opening to assure that intrusion of the ambient environment through the enclosure opening is prevented.

21. The apparatus of claim 19 wherein said blower control means includes a gain control means for initial adjustment of said blower means to produce a preselected cryogen outflow out of said one opening, said blower control means thereafter automatically responding to said cryogen control signal.

* * * * *